US006776077B1

(12) United States Patent
Chen

(10) Patent No.: US 6,776,077 B1
(45) Date of Patent: Aug. 17, 2004

(54) ROLLER BLADE CUTTING DEVICE

(76) Inventor: Chieh-Tang Chen, No. 6, Ming DE St., Hua Tan Hsiang, Chang Hua Hsien (TW)

( * ) Notice: Subject to any disclaimer, the term of this patent is extended or adjusted under 35 U.S.C. 154(b) by 16 days.

(21) Appl. No.: 10/397,894

(22) Filed: Mar. 26, 2003

(51) Int. Cl.[7] ..... B26D 5/10
(52) U.S. Cl. ..... 83/455; 83/485; 83/614
(58) Field of Search ..... 83/485, 455, 564, 83/588, 614, 486.1, 607–609, 578, 563, 597, 513, 451, 454, 469, 481, 483, 508, 523; 248/456, 452, 449, 451; 108/25, 44, 26, 133, 128

(56) References Cited

U.S. PATENT DOCUMENTS 4,243,184 A * 1/1981 Wright ..... 241/273.2
5,322,001 A * 6/1994 Boda ..... 83/485
5,366,197 A * 11/1994 Westland ..... 248/456
5,443,018 A * 8/1995 Cromwell ..... 108/44
5,480,058 A * 1/1996 Hutchins ..... 220/478
5,518,217 A * 5/1996 Deutsch et al. ..... 248/463
5,524,515 A * 6/1996 Boda ..... 83/455
5,671,647 A * 9/1997 Mori ..... 83/56
5,802,942 A * 9/1998 Cornell et al. ..... 83/455
5,927,214 A * 7/1999 Schwartz et al. ..... 108/128
5,996,459 A * 12/1999 Cornell et al. ..... 83/485
6,082,271 A * 7/2000 Gosselin et al. ..... 108/133
6,098,515 A * 8/2000 Daley, Jr. ..... 83/485
6,217,075 B1 * 4/2001 Tsai ..... 281/45
6,439,133 B1 * 8/2002 Jaramillo ..... 108/25
6,460,443 B1 * 10/2002 Hsiao ..... 83/614
D477,017 S * 7/2003 Vossler et al. ..... D18/34
2002/0040667 A1 * 4/2002 Birsel et al. ..... 108/25
2002/0092396 A1 * 7/2002 Hsiao ..... 83/454
2003/0140761 A1 * 7/2003 Schulz ..... 83/614

* cited by examiner

*Primary Examiner*—Allan N. Shoap
*Assistant Examiner*—Ghassem Alie
(74) *Attorney, Agent, or Firm*—Charles E. Baxley

(57) ABSTRACT

A cutting device includes a main board having a pressing member pivotably connected between two frames pivotably connected on two ends of the main board. A cutting mechanism is movably engaged to a side of the pressing member and has a roller blade therein. The pressing member presses on the sheets on the main board and the roller blade cuts the sheets by moving the cutting mechanism along the pressing member.

1 Claim, 6 Drawing Sheets

ROLLER BLADE CUTTING DEVICE

FIELD OF THE INVENTION

The present invention relates to a cutting device having a blade reciprocally movable on the board so as to make a sharp cut edge of the sheets of paper.

BACKGROUND OF THE INVENTION

A conventional cutting device for cutting sheets of paper is generally includes a board and a cutting blade is pivotably connected to an end of the board and the other end of the cutting blade is connected with a handle so that the user may pivoted upward the blade so as to put sheets on the board. The blade is then pivoted downward to cut the sheets by shear force. The edge that is cut by the blade of the sheets is often rough especially when there is a certain thick pile of the sheets, and this is not satisfied by the users. After the cutting is done, the blade is pivoted upward and positioned by a spring so that the blade will not drop to hurt the users. Nevertheless, an impact to the cutting device could result in the drop of the blade and this is dangerous. Besides, the force exerted onto the sheets is not even so that the edge that is cut could not be kept as a straight line and the sheets are not well pressed in position during the cut.

The present invention intends to provide a cutting device that has a pressing member to hold the sheets in position and the roller blade cuts the sheets along the guide of the side of the pressing member so maintain a straight cut.

SUMMARY OF THE INVENTION

In accordance with one aspect of the present invention, there is provided a cutting device which comprises a main board having a durable plate engaged in a groove defined in a top surface of the main board and an extended board is pivotably connected to a side of the main board. Two frames are pivotably engaged with two ends of the main board and a pressing member is connected between the two frames. A cutting mechanism is movably engaged to a side of the pressing member and has a roller blade therein.

The primary object of the present invention is to provide a cutting device that cuts the sheets on the main board and the sheets are pressed in position by a pressing member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
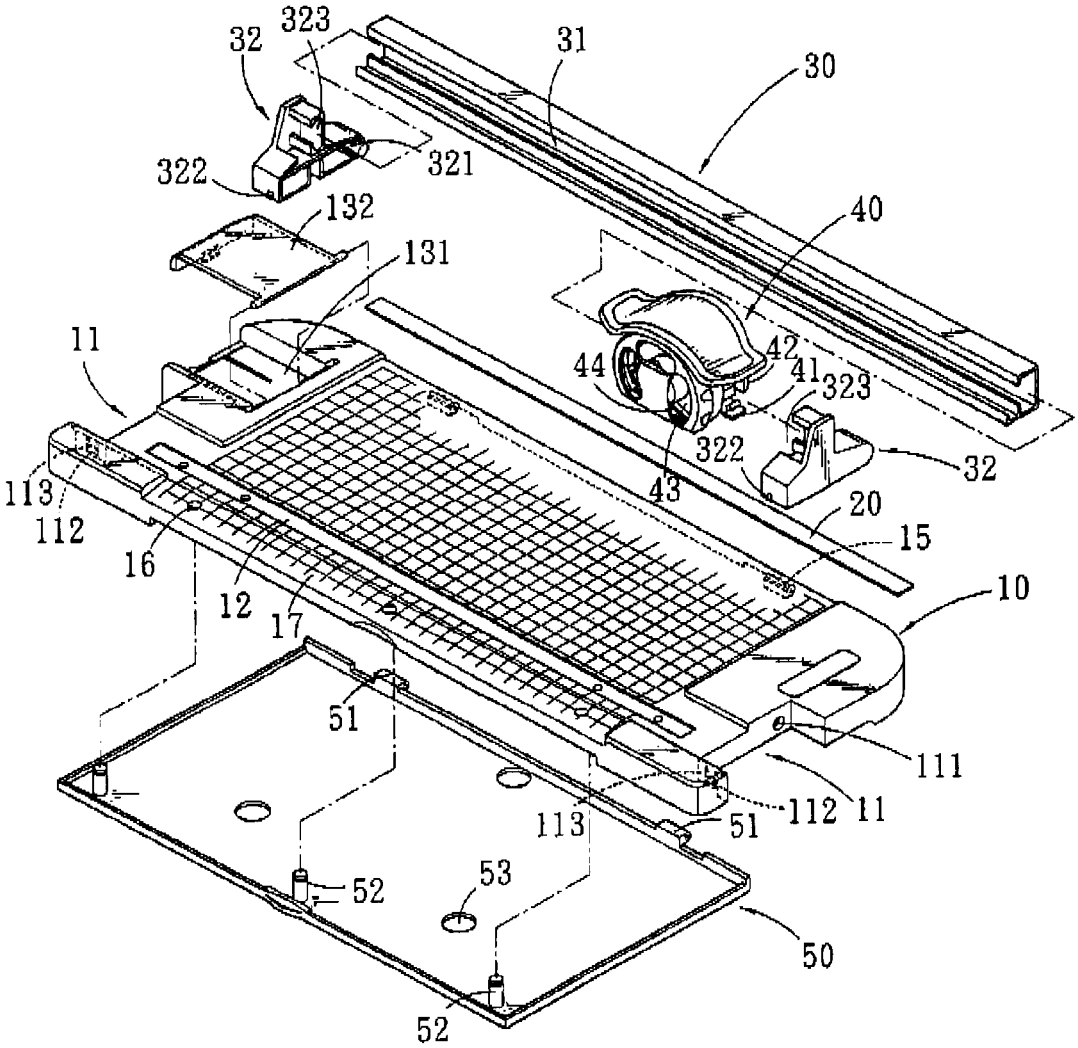
FIG. 1 is an exploded view to show a cutting device of the present invention.
Figure 2:
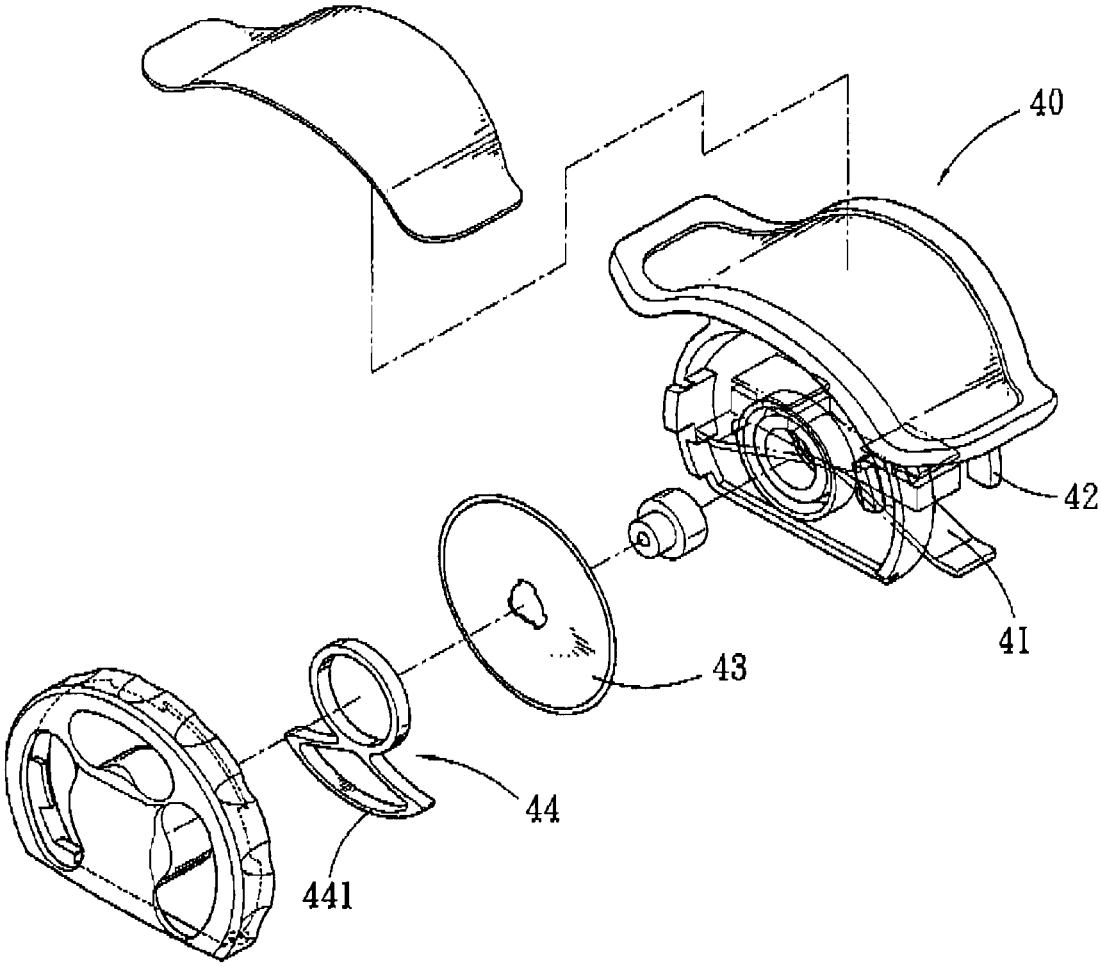
FIG. 2 is an exploded view to show a cutting mechanism of the cutting device of the present invention.
Figure 3:
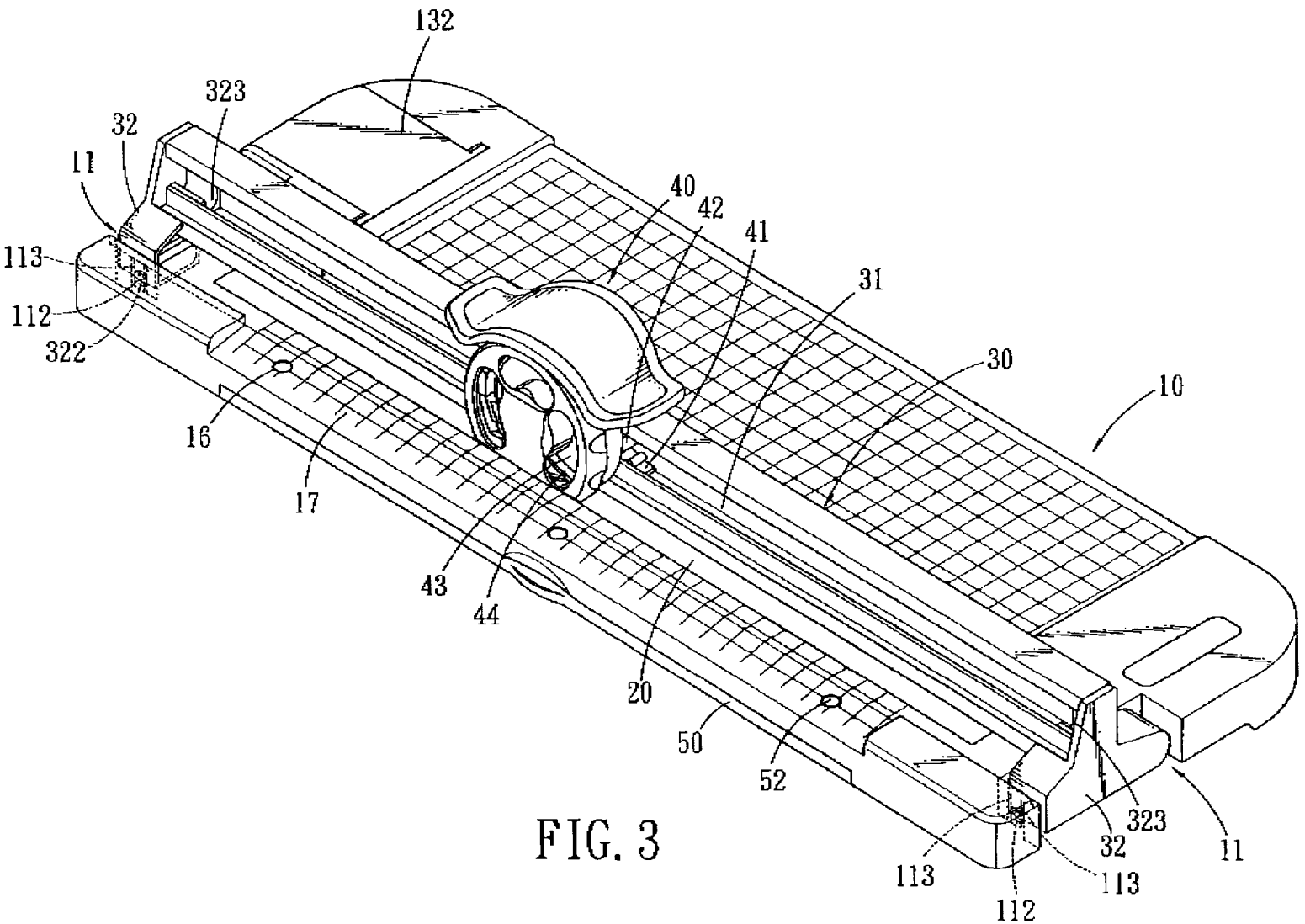
FIG. 3 is a perspective view to show the cutting device of the present invention.

Referring to FIGS. 1 to 3, the cutting device of the present invention comprises a main board 10 which has a durable plate 20 engaged in a groove 12 defined in a top surface of the main board 10 and two recesses 11 are defined in two ends of the main board 10. A hole 111 and a positioning lug 112 are respectively defined on two insides of each of the two recesses 11. Two long narrow slits 113 are defined on two sides of the inside of each of the recesses 11 and the positioning lug 112 is located between the two slits so that the positioning lug 112 is flexible to be pressed and bounces back after the pressure is removed. A recessed area 131 is defined in the top surface of the main board 10 for receiving small parts such as clips or staples. A cover 132 is connected to the main board 10 to cover the recessed area 131. A plurality of legs 14 extend from an underside of the main board 10.

Two frames 32 are pivotably engaged with two ends of the main board 10 and a pressing member 30 is connected between the two frames 32. Each of the frames 32 includes a shaft 321 for receiving the hole 111 corresponding thereto and an engaging part 322 for being engaged with the positioning lug 112 corresponding thereto. An engaging portion 323 is located to each of the two frames 32 and can be engaged with the groove 31 defined in the side of the pressing member 30.

Figure 5:
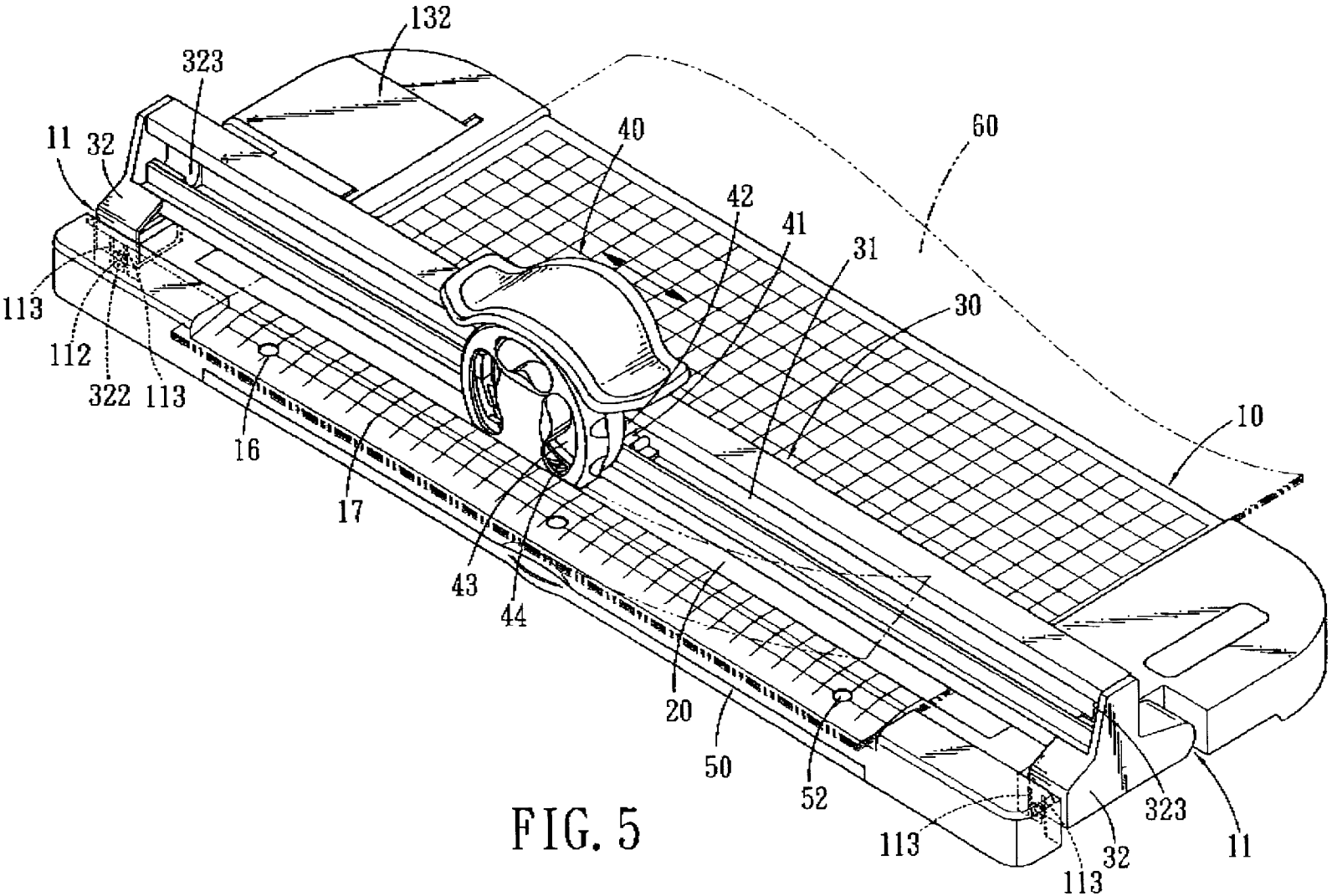
FIG. 5 is a perspective view to show the cutting mechanism cuts the sheets.

A cutting mechanism 40 is movably engaged to a side of the pressing member 30 and has a roller blade 43 therein. The cutting mechanism 40 has a spring plate 41 and an engaging block 42 so as to be respectively engaged with the groove 31 defined in the side of the pressing member 30. A flexible member 44 is connected to the cutting mechanism and includes a bow-shaped part 441 which normally covers the roller blade 43 so as to prevent from injury to the users. The bow-shaped part 441 can be easily deformed when pressing a force to the flexible member 44, and the roller blade 43 is exposed to cut sheets 60 on the main board 10 as shown in FIG. 5.

Figure 4:
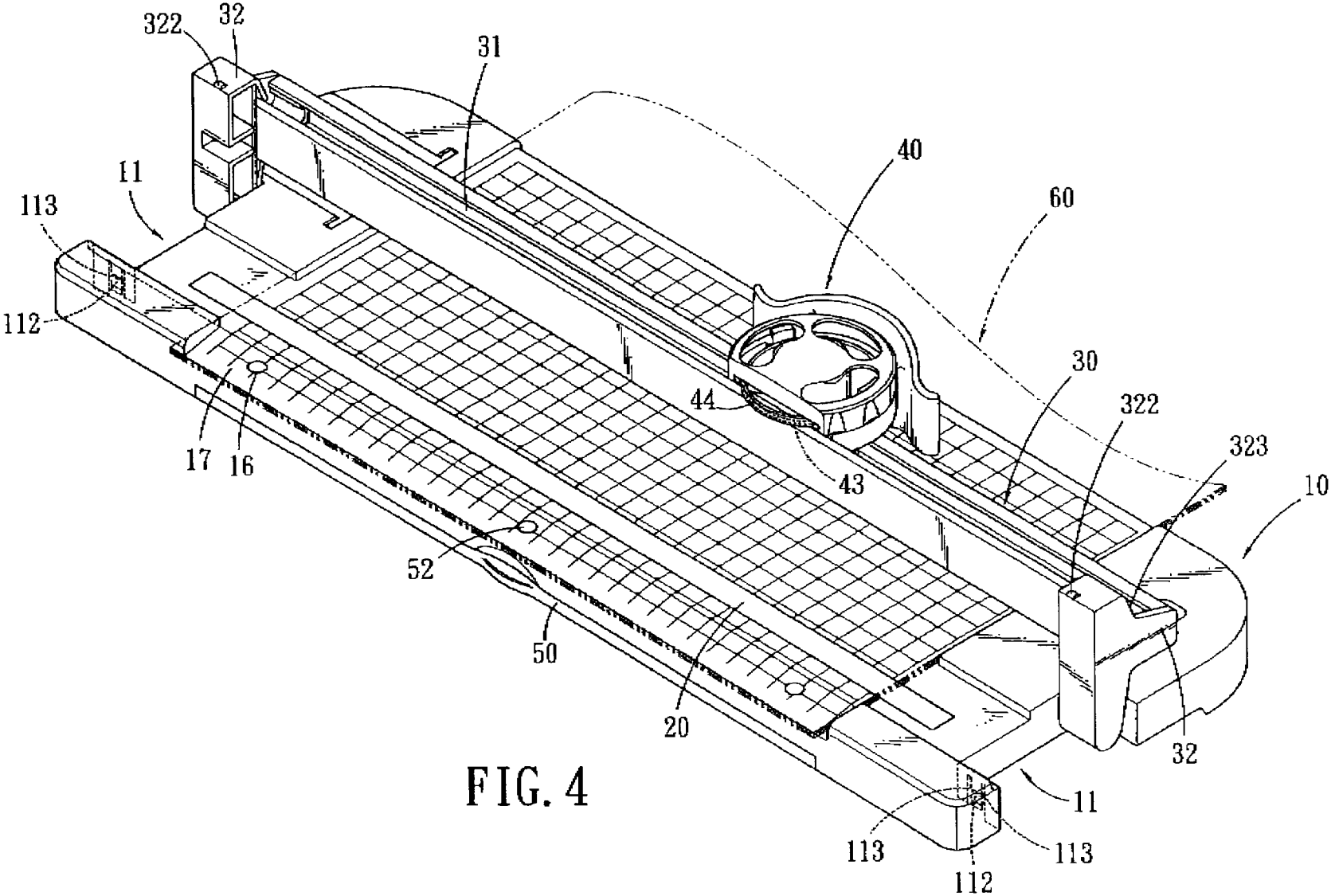
FIG. 4 is a perspective view to show that the pressing member and the cutting mechanism are pivoted relative to the top surface of the main board of the cutting device of the present invention.

As shown in FIG. 4, the pressing member 30 and the cutting mechanism 40 can be pivoted by pivoting the pressing member 30 about the shafts 321 and the sheets 60 can be put on the main board 10 and be pressed in position by pivoting the pressing member 30 on the top of the sheets 60. The engaging parts 322 of the two frames 32 are then engaged with the positioning lugs 112 to position the two frames 32 again. The users may press and push the cutting mechanism 40 to cut the sheets 60. The main board 10 has an inclined surface 17 defined in a side thereof so as to allow the sheets to be cut to slip.

Figure 6:
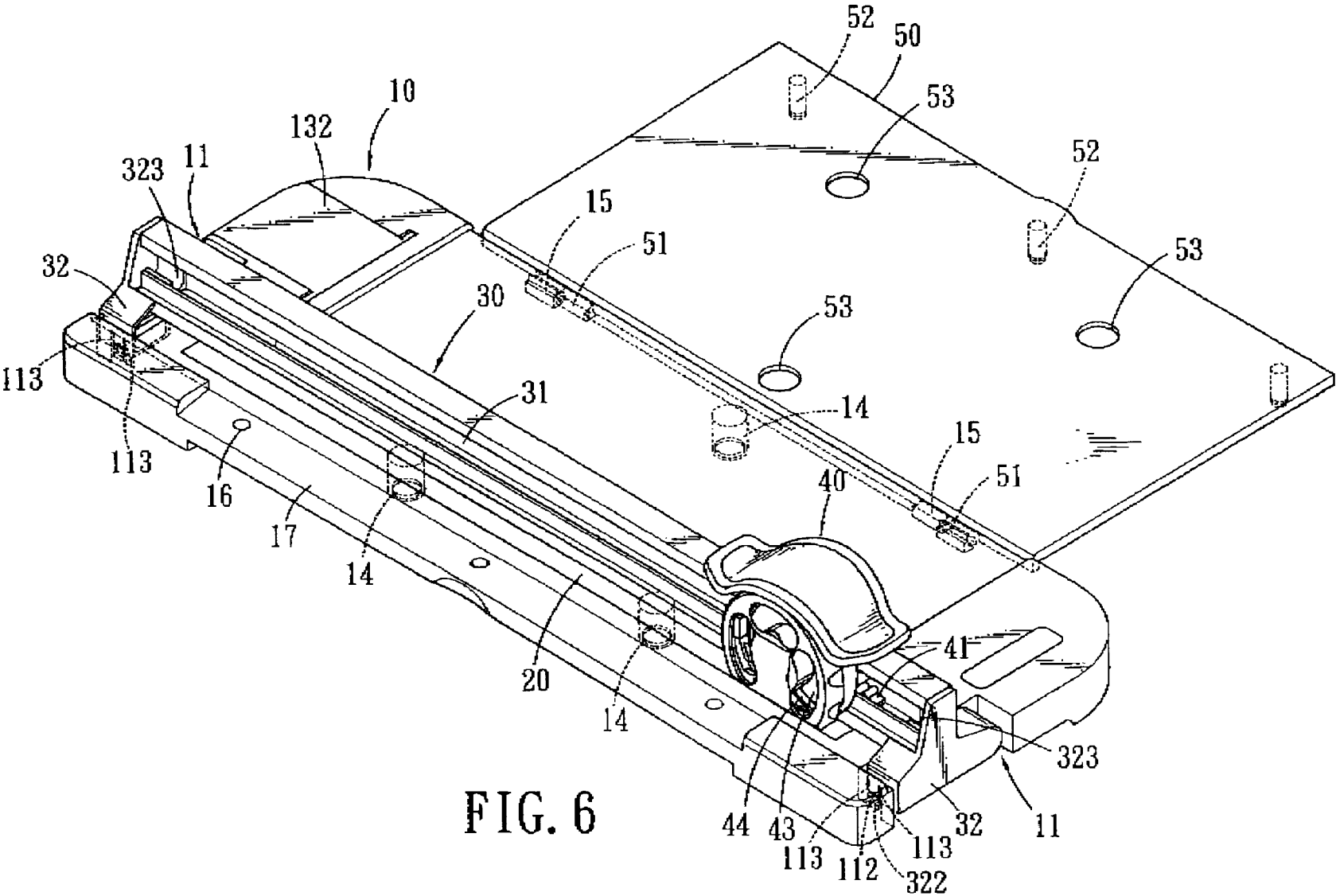
FIG. 6 shows the extended board is expanded.

Further referring to FIG. 6, an extended board 50 is pivotably connected to a side of the main board 10 by engaging the connection ears 51 on a side of the extended board 50 with the connection ears 15 on the side of the main board 10. The extended board 50 has support legs 52 extending from an underside thereof and a plurality of first apertures 16 are defined through the main board 10 so as to receive the support legs 52 when the extended board 50 is folded to the underside of the main board 10. A plurality of second apertures 53 are defined through the extended board 50 and the legs 14 on the main board 10 can be received in the second apertures 53 when the extended board 50 is folded to the underside of the main board 10. The extended board 50 can be expanded so as to support long sheets to be cut.

While we have shown and described the embodiment in accordance with the present invention, it should be clear to those skilled in the art that further embodiments may be made without departing from the scope of the present invention.

What is claimed is:

1. A cutting device comprising:

a main board having a durable plate engaged in a groove defined in a top surface of the main board, an extended board pivotably connected to a side of the main board;

two frames pivotably engaged with two ends of the main board and a pressing member connected between the two frames, and a cutting mechanism movably engaged to a side of the pressing member and having a roller blade therein, and the extended board having support legs extending from an underside thereof and a plurality of first apertures being defined through the main board so as to receive the support legs when the extended board is folded to the underside of the main board, a plurality of second apertures defined through the extended board and the legs on the main board received in the second apertures when the extended board is folded to the underside of the main board.

* * * * *